US008366890B2

(12) United States Patent
Urgeghe et al.

(10) Patent No.: US 8,366,890 B2
(45) Date of Patent: Feb. 5, 2013

(54) ELECTRODE FOR ELECTROLYSIS CELL

(75) Inventors: Christian Urgeghe, Redecesio Segrate (MI), (IT); Alexander Morozov, Moscow, (RU); Alice Calderara, Agnadello (CR), (IT); Dino Floriano Di Franco, Mayfield Village, OH (US); Antonio Lorenzo Antozzi, Merate (LC), (IT)

(73) Assignee: Industrie de Nora S.p.A., Milan (IT)

( * ) Notice: Subject to any disclaimer, the term of this patent is extended or adjusted under 35 U.S.C. 154(b) by 96 days.

(21) Appl. No.: 13/106,133

(22) Filed: May 12, 2011

(65) Prior Publication Data

US 2011/0209992 A1 Sep. 1, 2011

Related U.S. Application Data

(63) Continuation of application No. PCT/EP2009/064998, filed on Nov. 11, 2009.

(30) Foreign Application Priority Data

Nov. 12, 2008 (IT) ..... MI2008A2005

(51) Int. Cl.
*C25B 11/08* (2006.01)
*C25B 11/06* (2006.01)
*C25B 11/04* (2006.01)

(52) U.S. Cl. ..... 204/291; 204/292; 204/252; 427/126.3; 427/126.5; 427/331; 427/372.2; 427/379; 427/380

(58) Field of Classification Search ..... 204/291, 204/292, 252; 427/126.3, 126.5, 331, 372.2, 427/379, 380
See application file for complete search history.

(56) References Cited

U.S. PATENT DOCUMENTS

| | | | | |
|---|---|---|---|---|
| 3,770,613 | A * | 11/1973 | Chisholm | 204/290.06 |
| 4,970,094 | A * | 11/1990 | Byrd | 427/126.5 |
| 7,695,755 | B2 * | 4/2010 | Morozov et al. | 427/58 |
| 8,182,600 | B2 * | 5/2012 | Morozov et al. | 106/287.19 |
| 2004/0224216 | A1 * | 11/2004 | Burlatsky et al. | 429/40 |
| 2011/0212829 | A1 * | 9/2011 | DiMascio | 502/63 |

FOREIGN PATENT DOCUMENTS

| | | | |
|---|---|---|---|
| EP | 0153586 | A1 | 9/1985 |
| WO | 2005014885 | A1 | 2/2005 |

OTHER PUBLICATIONS

International Search Report for Application No. PCT/EP2009/064998 dated Feb. 11, 2010, 3 pages.

* cited by examiner

*Primary Examiner* — Bruce Bell
(74) *Attorney, Agent, or Firm* — Eschweiler & Associates, LLC

(57) ABSTRACT

The invention relates to an electrode formulation comprising a catalytic layer containing tin, ruthenium, iridium, palladium and niobium oxides applied to a titanium or other valve metal substrate. A protective layer based on titanium oxide modified with oxides of other elements such as tantalum, niobium or bismuth may be interposed between the substrate and the catalytic layer. The thus obtained electrode is suitable for use as an anode in electrolysis cells for chlorine production.

10 Claims, No Drawings

ELECTRODE FOR ELECTROLYSIS CELL

CROSS-REFERENCE TO RELATED APPLICATION

This application is a continuation of PCT/EP2009/064998 filed Nov. 11, 2009, that claims the benefit of the priority date of Italian Patent Application No. M12008A002005 filed Nov. 12, 2008, the contents of which are herein incorporated by reference in their entirety.

FIELD OF THE INVENTION

The inventions relates to an electrode suitable for functioning as an anode in electrolysis cells, for instance as an anode for chlorine evolution in chlor-alkali cells.

BACKGROUND OF THE INVENTION

The electrolysis of alkali chloride brines, for instance of sodium chloride brine for the production of chlorine and caustic soda, is often carried out with titanium or other valve metal-based anodes activated with a superficial layer of ruthenium dioxide ($RuO_2$), which has the property of lowering the overvoltage of anodic chlorine evolution reaction. A typical formulation of catalyst for chlorine evolution consists of a $RuO_2$ and $TiO_2$ mixture, which has a sufficiently reduced anodic chlorine evolution overvoltage. Beside the need for resorting to very high ruthenium loadings to obtain a satisfactory lifetime at the usual process conditions, such formulation has the disadvantage of a reduced overvoltage of the anodic oxygen evolution reaction. This causes the concurrent anodic oxygen evolution reaction to be not effectively inhibited, so that product chlorine presents an oxygen content which is too high for some uses.

The same considerations apply for formulations based on $RuO_2$ mixed with $SnO_2$, or for ternary mixtures of ruthenium, titanium and tin oxides. In general, catalysts capable of sufficiently lowering the overvoltage of the chlorine evolution reaction, so as to guarantee an acceptable energy efficiency, tend to have the same effect on the concurrent oxygen evolution reaction, giving rise to a product of unsuitable purity. A known example in this regard is given by palladium-containing catalyst formulations, which are capable of carrying out chlorine evolution at sensibly reduced potentials, but with a much higher content of oxygen in the chlorine, in addition to their limited lifetime.

A partial improvement in terms of duration and of oxygen evolution inhibition is obtainable by adding a formulation of $RuO_2$ mixed with $SnO_2$ with a certain amount of a second noble metal selected between iridium and platinum, as described in the prior art. The activity of this electrode—in terms of cell voltage and consequently of energy consumption—is nevertheless not yet ideal for the economics of a large scale industrial production.

It becomes therefore necessary to identify a catalyst formulation for an electrode suitable for functioning as a chlorine-evolving anode in industrial electrolysis cells presenting characteristics of improved anodic chlorine evolution potential jointly with an adequate purity of product chlorine.

SUMMARY OF THE INVENTION

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter. As provided herein, the invention comprises, under one aspect an electrode suitable for operating as an anode in electrolysis cells comprising a valve metal substrate and an external catalytic layer containing oxides of tin, ruthenium, iridium, palladium and niobium in a Sn 50-70%, Ru 5-20%, Ir 5-20%, Pd 1-10%, Nb 0.5-5% elementary molar ratio.

In another aspect the invention comprises a method for manufacturing an electrode, comprising applying multiple coats of a precursor solution containing Sn, Ir and Ru hydroxyacetochloride complexes, at least one Pd soluble species and at least one Nb soluble species to a valve metal substrate, and executing after each coat a thermal treatment at a maximum temperature of 400° C. to 480° C. for a duration of 15 to 30 minutes.

In a still further aspect, the invention comprises A method for manufacturing an, electrode, comprising applying multiple coats of a first hydroalcoholic solution containing a titanium hydroxyacetochloride complex and at least one salt of titanium, niobium or bismuth to a valve metal substrate with execution after each coat of a thermal treatment at a maximum temperature of 400 to 480° C. for a duration of 15 to 30 minutes, and applying multiple coats of a second hydroalcoholic solution containing Sn, Ir and Ru hydroxyacetochloride complexes, at least one Pd soluble species and at least one Nb soluble species with execution after each coat of a thermal treatment at a maximum temperature of 400 to 480° C. for a duration of 15 to 30 minutes.

In another aspect, the invention comprises an electrolysis cell comprising a cathodic compartment containing a cathode and an anodic compartment containing an anode separated by a membrane or diaphragm, the anodic compartment being fed with an alkali chloride brine, wherein the anode of the anodic compartment comprises an electrode comprising a valve metal substrate and an external catalytic layer containing oxides of tin, ruthenium, iridium, palladium and niobium in a Sn 50-70%, Ru 5-20%, Ir 5-20%, Pd 1-10%, Nb 0.5-5% elementary molar ratio.

To the accomplishment of the foregoing and related ends, the following description sets forth certain illustrative aspects and implementations. These are indicative of but a few of the various ways in which one or more aspects may be employed. Other aspects, advantages, and novel features of the disclosure will become apparent from the following detailed description.

DESCRIPTION

Several aspects of the invention are set forth in the appended claims.

In one embodiment, the invention relates to an electrode comprising a substrate of titanium, titanium alloy or other valve metal provided with a superficially applied external catalytic coating containing a mixture of oxides of tin, ruthenium, iridium, palladium and niobium in a molar ratio, referred to the elements, Sn 50-70%, Ru 5-20%, Ir 5-20%, Pd 1-10%, Nb 0.5-5%. The simultaneous addition of palladium and niobium at the above indicated concentrations to a catalyst layer based on a tin, ruthenium and iridium oxide-based formulation presents the characteristic of sensibly reducing the potential of the anodic chlorine evolution reaction while keeping the one of the anodic oxygen evolution reaction high, resulting in the double advantage of permitting an energy consumption reduction per unit product and at the same time of increasing the purity of the obtained chlorine. As previously stated, the catalytic action of palladium towards the reaction of anodic chlorine evolution has not found a practical application in industrial electrolysers due to a weaker chemical resistance and especially due to the high quantity of oxygen produced by the relevant concurrent anodic reaction. The inventors have surprisingly found out that a small addition of niobium oxide in the catalytic layer has an effective role in inhibiting the oxygen discharge reaction even in the presence of palladium, allowing operation of the cell with voltages a few tens mV lower than in the processes of the prior art, without losing anything in terms of purity of product chlorine. A 0.5% molar addition Nb is sufficient to obtain a remarkable inhibiting effect of the anodic oxygen evolution reaction. In one embodiment, the molar content of Nb referred to the elements is comprised between 1 and 2%.

The anodic potential has a tendency to decrease at increasing amounts of palladium oxide in the catalytic coating. A 1% amount is sufficient to impart a sensible catalytic effect, while the upper limit of 10% is mainly set for reasons of stability in a chloride-rich environment rather than in view of an increased oxygen production. A Pd addition not exceeding 10% molar, jointly with the presence of niobium oxide at the specified levels, allows to obtain electrodes having a duration totally compatible with the requirements of an industrial application, likely by virtue of the formation of mixed crystalline phases having a stabilising effect.

The inventors also noticed that the deposition of the catalytic layer, which is known to be effected by multi-cycle application and thermal decomposition of solutions of soluble compounds of the various elements, may be carried out, in the case of formulations containing small quantities of niobium, at a lower temperature than in the case of the known formulations based on tin, ruthenium and iridium, for instance at 440-480° C. rather than 500° C. Without wishing the invention to be bound to any particular theory, the inventors assume that part of the beneficial effect on the electrode potential, and thus on the cell voltage, obtainable with the indicated composition is due to the lower temperature required by the thermal treatment following the coating application. It is known, in fact, that in the case of generic formulations, lower decomposition temperatures are generally associated to a lower anodic potential.

In one embodiment, the electrode is provided with a $TiO_2$-containing intermediate layer interposed between the substrate and the above described external catalytic layer. This can have the advantage of conferring some protection against the aggressiveness of the chemical environment whereto the electrode is exposed during operation, for instance by slowing down the passivation of the substrate valve metal or by inhibiting the corrosion thereof. In one embodiment, $TiO_2$ is mixed with a small amount, for instance 0.5 to 3%, of other oxides such as tantalum, niobium or bismuth oxide. The addition of such oxides to $TiO_2$, besides increasing its electrical conductivity by doping effect, can have the advantage of conferring a better adhesion of the external catalytic layer to the protective interlayer, which results in a further increase of the electrode lifetime at the usual functioning conditions.

In one embodiment, the electrode in accordance with the above description is manufactured by oxidative pyrolysis of a precursor solution containing tin, iridium and ruthenium as hydroxyacetochloride complexes, such as $Sn(OH)_2Ac_{(2-x)}Cl_x$, $Ir(OH)_2Ac_{(2-x)}Cl_x$, $Ru(OH)_2Ac_{(2-x)}Cl$. This can have the advantage of stabilising the composition of the various elements and especially of tin throughout the whole coating thickness with respect to what occurs with precursors of more common use such as $SnCl_4$, whose volatility results in hardly controllable variations of the concentration. An accurate control of the composition of the various components facilitates the inclusion thereof as monophasic crystals, which can play a positive role in the stabilisation of palladium.

In one embodiment, an optional hydroalcoholic solution of Sn, Ru and Ir hydroxyacetochloride complexes containing a soluble Pd species and a soluble Nb species is applied in multiple coats to a valve metal substrate with execution, after each coat, of a thermal treatment at a maximum temperature of 400 to 480° C. for a time of 15 to 30 minutes. The above indicated maximum temperature corresponds in general to the temperature whereat the precursor thermal decomposition is completed with formation of the relevant oxides. Such step can be preceded by a drying step at lower temperature, for example 100-120° C. The use of a hydroalcoholic solution can present advantages in terms of facility of application and effectiveness of solvent withdrawal during the drying step.

In one embodiment, the soluble Pd species in the precursor solution consists of $Pd(NO_3)_2$ in aqueous nitric acid solution. In ne embodiment, the soluble Pd species in the precursor solution consists of $PdCl_2$ in ethanol. In one embodiment, the soluble Nb species in the precursor solution consists of $NbCl_5$ in butanol.

In one embodiment, an electrode comprising a protective intermediate layer and an external catalytic layer is manufactured by oxidative pyrolysis of a first hydroalcoholic solution containing titanium, for instance as hydroxyacetochloride complex, and at least one of tantalum, niobium and bismuth, for instance as soluble salt, until obtaining the protective interlayer. Subsequently, the catalytic layer is obtained by oxidative pyrolysis of a precursor solution applied to the protective intermediate layer, according to the above described procedure.

In one embodiment, a hydroalcoholic solution of a Ti hydroxyacetochloride complex containing one soluble species, for instance a soluble salt, of at least one element selected between Ta, Nb and Bi, is applied in multiple coats to a valve metal substrate with execution, after each coat, of a thermal treatment at a maximum temperature of 400 to 480° C. for a time of 15 to 30 minutes. Subsequently, an optionally hydroalcoholic solution of Sn, Ru and Ir hydroxyacetochloride complexes containing a Pd soluble species and a Nb soluble species is applied in multiple coats to a valve metal substrate with execution, after each coat, of a thermal treatment at a maximum temperature of 400 to 480° C. for a time of 15 to 30 minutes. Also in this case, the above indicated maximum temperature corresponds in general to the temperature whereat the precursor thermal decomposition is completed with formation of the relevant oxides; such step can be preceded by a drying step at lower temperature, for example 100-120° C.

In one embodiment, the $BiCl_3$ species is dissolved in an acetic solution of a Ti hydroxyacetochloride complex, which is subsequently added with $NbCl_5$ dissolved in butanol.

In one embodiment, an acetic solution of a Ti hydroxyacetochloride complex is added with $TaCl_5$ dissolved in butanol.

The invention will be better understood by aid of the following examples, which shall not be intended as a limitation of the scope thereof.

EXAMPLE 1

A piece of titanium mesh of 10 cm×10 cm size was sandblasted with corundum, cleaning the residues of the treatment by means of a compressed air jet. The piece was then degreased making use of acetone in a ultrasonic bath for about 10 minutes. After a drying step, the piece was dipped in an aqueous solution containing 250 g/l of NaOH and 50 g/l of $KNO_3$ at about 100° C. for 1 hour. After the alkaline treatment, the piece was rinsed three times with deionised water at 60° C., changing the liquid every time. The last rinsing step was carried out adding a small amount of HCl (about 1 ml per liter of solution). An air-drying was effected, observing the formation of a brown colouring due to the growth of a thin film of $TiO_x$.

100 ml of a 1.3 M hydroalcoholic solution of the Ti-based precursor, suitable for the deposition of a protective layer of 98% Ti, 1% Bi, 1% Nb molar composition were then prepared, making use of the following components:

65 ml of 2 M Ti hydroxyacetochloride complex solution;
32.5 ml of ethanol, reagent grade;
0.41 g of $BiCl_3$;
1.3 ml of 1M $NbCl_5$ butanol solution.

The 2 M Ti hydroxyacetochloride complex solution was obtained by dissolving 220 ml of $TiCl_4$ in 600 ml of 10% vol. aqueous acetic acid controlling the temperature below 60° C. by means of an ice bath and bringing the obtained solution to volume with the same 10% acetic acid until reaching the above indicated concentration. $BiCl_3$ was dissolved in the Ti hydroxyacetochloride complex solution under stirring, then were the $NbCl_5$ solution and the ethanol were added. The obtained solution was then brought to volume with 10% vol. aqueous acetic acid. An about 1:1 volume dilution led to a Ti final concentration of 62 g/l.

The obtained solution was applied to the previously prepared titanium piece by multi-coat brushing, until reaching a $TiO_2$ loading of about 3 g/m$^2$. After each coat, a drying step at 100-110° C. was carried out for about 10 minutes, followed by a thermal treatment at 420° C. for 15-20 minutes. The piece was cooled in air each time before applying the subsequent coat. The required loading was reached by applying two coats of the above indicated hydroalcoholic solution. Upon completion of the application, a matte grey-coloured electrode was obtained.

100 ml of a precursor solution suitable for the deposition of a catalytic layer of 20% Ru, 10% Ir, 10% Pd, 59% Sn, 1% Nb molar composition were also prepared, making use of the following components:

42.15 ml of 1.65 M Sn hydroxyacetochloride complex solution;
12.85 ml of 0.9 M Ir hydroxyacetochloride complex solution;
25.7 ml of 0.9 M Ru hydroxyacetochloride complex solution;
12.85 ml of 0.9M $Pd(NO_3)_2$ solution, acidified with nitric acid;
1.3 ml of 1M $NbCl_5$ butanol solution;
5 ml of ethanol, reagent grade.

The Sn hydroxyacetochloride complex solution was prepared according to the procedure disclosed in WO 2005/014885; the Ir and Ru hydroxyacetochloride complex solutions were obtained by dissolving the relevant chlorides in 10% vol. aqueous acetic acid, evaporating the solvent, washing with 10% vol. aqueous acetic acid with subsequent solvent evaporation two more times, finally dissolving the product again in 10% aqueous acetic acid to obtain the specified concentration. The hydroxyacetochloride complex solutions were pre-mixed, then the $NbCl_5$ solution and the ethanol were added under stirring.

The obtained solution was applied to the previously prepared titanium piece by multi-coat brushing, until reaching an overall noble metal loading of about 9 g/m$^2$, expressed as the sum of Ir, Ru and Pd referred to the elements. After each coat, a drying step at 100-110° C. was carried out for about 10 minutes, followed by a 15 minute thermal treatment at 420° C. for the first two coats, at 440° C. for the third and the fourth coat, at 460-470° C. for the subsequent coats. The piece was cooled in air each time before applying the subsequent coat. The required loading was reached by applying six coats of the precursor solution.

The electrode was tagged as sample A01.

EXAMPLE 2

A piece of titanium mesh of 10 cm×10 cm size was sandblasted with corundum, cleaning the residues of the treatment by means of a compressed air jet. The piece was then degreased making use of acetone in a ultrasonic bath for about 10 minutes. After a drying step, the piece was dipped in an aqueous solution containing 250 g/l of NaOH and 50 g/l of $KNO_3$ at about 100° C. for 1 hour. After the alkaline treatment, the piece was rinsed three times with deionised water at 60° C., changing the liquid every time. The last rinsing step was carried out adding a small amount of HCl (about 1 ml per liter of solution). An air-drying was effected, observing the formation of a brown colouring due to the growth of a thin film of $TiO_x$.

100 ml of a 1.3 M hydroalcoholic solution of the Ti-based precursor, suitable for the deposition of a protective layer of 98% Ti, 2% Ta molar composition were then prepared, making use of the following components:

65 ml of 2 M Ti hydroxyacetochloride complex solution;
32.5 ml of ethanol, reagent grade;
2.6 ml of 1M $TaCl_5$ butanol solution.

The hydroalcoholic Ti hydroxyacetochloride complex solution was the same of the previous Example.

The $TaCl_5$ solution was added to the Ti hydroxyacetochloride complex one under stirring, then ethanol was added. The obtained solution was then brought to volume with 10% vol. aqueous acetic acid. An about 1:1 volume dilution led to a Ti final concentration of 62 g/l.

The obtained solution was applied to the previously prepared titanium piece by multi-coat brushing, until reaching a $TiO_2$ loading of about 3 g/m$^2$. After each coat, a drying step at 100-110° C. was carried out for about 10 minutes, followed by a thermal treatment at 420° C. for 15-20 minutes. The piece was cooled in air each time before applying the subsequent coat. The required loading was reached by applying two coats of the above indicated hydroalcoholic solution. Upon completion of the application, a matte grey-coloured electrode was obtained.

The electrode was activated with a catalytic layer of 20% Ru, 10% Ir, 10% Pd, 59% Sn, 1% Nb molar composition as in Example 1, with the only difference that Pd was added as $PdCl_2$ previously dissolved in ethanol rather than as nitrate in acetic solution.

The electrode was tagged as sample B01.

COUNTEREXAMPLE

A piece of titanium mesh of 10 cm×10 cm size was sandblasted with corundum, cleaning the residues of the treatment by means of a compressed air jet. The piece was then degreased making use of acetone in a ultrasonic bath for about 10 minutes. After a drying step, the piece was dipped in an aqueous solution containing 250 g/l of NaOH and 50 g/l of $KNO_3$ at about 100° C. for 1 hour. After the alkaline treatment, the piece was rinsed three times with deionised water at 60° C., changing the liquid every time. The last rinsing step was carried out adding a small amount of HCl (about 1 ml per liter of solution). An air-drying was effected, observing the formation of a brown colouring due to the growth of a thin film of $TiO_x$.

A protective layer of 98% Ti, 2% Ta molar composition was then deposited on the electrode as in Example 2.

The electrode was activated with a catalytic layer of 25% Ru, 15% Ir, 60% Sn molar composition starting from the relevant hydroxyacetochloride complex solution, similarly to the previous examples. Also in this case an about 9 $g/m^2$ overall noble metal loading was applied, making use of the same technique.

The electrode was tagged as sample B00.

EXAMPLE 3

A series of samples tagged as A02-A11 was prepared with the reagents and the methodology as in Example 1 starting from pieces of titanium mesh of 10 cm×10 cm size pre-treated as above indicated and provided with a protective layer of 98% Ti, 1% Bi, 1% Nb molar composition, then with a catalytic layer having the composition and the specific noble metal loading reported in Table 1.

EXAMPLE 4

A series of samples tagged as B02-B11 was prepared with the reagents and the methodology as in Example 2 starting from pieces of titanium mesh of 10 cm×10 cm size pre-treated as above indicated and provided with a protective layer of 98% Ti, 2% Ta molar composition, then with a catalytic layer having the composition and the specific noble metal loading reported in Table 1.

EXAMPLE 5

The samples of the preceding Examples were characterised as chlorine-evolving anodes in a lab cell fed with a sodium chloride brine at a concentration of 220 g/l, strictly controlling the pH at a value of 2. Table 1 reports the chlorine overvoltage detected at a current density of 2 $kA/m^2$ and the oxygen percentage by volume in the product chlorine.

TABLE 1

| Sample | Composition (molar % referred to the elements) | | | | | Noble metal | $\eta Cl_2$ | $O_2$ |
|---|---|---|---|---|---|---|---|---|
| ID | Ru | Ir | Pd | Sn | Nb | ($g/m^2$) | (mV) | (%) |
| A01 | 20 | 10 | 10 | 59 | 1 | 9 | 44 | 0.5 |
| A02 | 15 | 10 | 5.5 | 68.5 | 1 | 9 | 49 | 0.4 |
| A03 | 5 | 20 | 10 | 64 | 1 | 9 | 46 | 0.5 |
| A04 | 19.8 | 5 | 8 | 65.2 | 2 | 9 | 46 | 0.5 |
| A05 | 20 | 10 | 1 | 67.3 | 1.7 | 9 | 52 | 0.4 |
| A06 | 20 | 19.5 | 10 | 50 | 0.5 | 9 | 45 | 0.5 |
| A07 | 19.5 | 19.5 | 5 | 51 | 5 | 9 | 48 | 0.4 |
| A08 | 10 | 10.8 | 7.7 | 70 | 1.5 | 9 | 48 | 0.5 |
| A09 | 19.8 | 9.9 | 9.9 | 59.4 | 1 | 5 | 47 | 0.5 |
| A10 | 5 | 20 | 10 | 64 | 1 | 5 | 49 | 0.5 |
| A11 | 19.8 | 5 | 8 | 65.2 | 2 | 5 | 48 | 0.5 |
| B01 | 20 | 10 | 10 | 59 | 1 | 9 | 45 | 0.5 |
| B02 | 15 | 10 | 5.5 | 68.5 | 1 | 9 | 49 | 0.4 |
| B03 | 5 | 20 | 10 | 64 | 1 | 9 | 47 | 0.5 |
| B04 | 19.8 | 5 | 8 | 65.2 | 2 | 9 | 45 | 0.5 |
| B05 | 20 | 10 | 1 | 67.3 | 1.7 | 9 | 54 | 0.4 |
| B06 | 20 | 19.5 | 10 | 50 | 0.5 | 9 | 44 | 0.5 |
| B07 | 19.5 | 19.5 | 5 | 51 | 5 | 9 | 48 | 0.5 |
| B08 | 10 | 10.8 | 7.7 | 70 | 1.5 | 9 | 46 | 0.6 |
| B09 | 19.8 | 9.9 | 9.9 | 59.4 | 1 | 5 | 45 | 0.5 |
| B10 | 5 | 20 | 10 | 64 | 1 | 5 | 51 | 0.5 |
| B11 | 19.8 | 5 | 8 | 65.2 | 2 | 5 | 48 | 0.5 |
| B00 | 25 | 15 | — | 60 | — | 9 | 60 | 0.7 |

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

What we claim is:

1. Electrode suitable for operating as an anode in electrolysis cells comprising a valve metal substrate and an external catalytic layer containing oxides of tin, ruthenium, iridium, palladium and niobium in a Sn 50-70%, Ru 5-20%, Ir 5-20%, Pd 1-10%, Nb 0.5-5% elementary molar ratio.

2. The electrode according to claim 1, comprising a protective layer containing $TiO_2$ interposed between the valve metal substrate and the external catalytic layer.

3. The electrode according to claim 2, wherein the protective layer containing $TiO_2$ is added with tantalum, niobium or bismuth oxides in an overall elementary molar ratio of 0.5 to 3%.

4. A method for manufacturing an electrode, comprising:

applying multiple coats of a precursor solution containing Sn, Ir and Ru hydroxyacetochloride complexes, at least one Pd soluble species and at least one Nb soluble species to a valve metal substrate; and executing after each coat a thermal treatment at a maximum temperature of 400° C. to 480° C. for a duration of 15 to 30 minutes.

5. The method according to claim 4, wherein the at least one Pd soluble species comprises one or more of $Pd(NO_3)_2$ previously dissolved in a nitric acid aqueous solution and $PdCl_2$ previously dissolved in ethanol, and the at least one Nb soluble species is $NbCl_5$ previously dissolved in butanol.

6. A method for manufacturing an electrode, comprising:

applying multiple coats of a first hydroalcoholic solution containing a titanium hydroxyacetochloride complex and at least one salt of titanium, niobium or bismuth to a valve metal substrate with execution after each coat of a thermal treatment at a maximum temperature of 400 to 480° C. for a duration of 15 to 30 minutes; and applying multiple coats of a second hydroalcoholic solution containing Sn, Ir and Ru hydroxyacetochloride complexes, at least one Pd soluble species and at least one Nb soluble species with execution after each coat of a thermal treatment at a maximum temperature of 400 to 480° C. for a duration of 15 to 30 minutes.

7. The method according to claim 6, wherein the first hydroalcoholic solution is prepared by dissolution of $BiCl_3$ in an acetic solution of a titanium hydroxyacetochloride complex and subsequent addition of $NbCl_5$ dissolved in butanol.

8. The method according to claim 6, wherein the first hydroalcoholic solution is prepared by addition of $TaCl_5$ dissolved in butanol to an acetic solution of a titanium hydroxy-acetochloride complex.

9. An electrolysis cell comprising a cathodic compartment containing a cathode and an anodic compartment containing an anode separated by a membrane or diaphragm, the anodic compartment being fed with an alkali chloride brine, wherein the anode of the anodic compartment comprises an electrode comprising a valve metal substrate and an external catalytic layer containing oxides of tin, ruthenium, iridium, palladium and niobium in a Sn 50-70%, Ru 5-20%, Ir 5-20%, Pd 1-10%, Nb 0.5-5% elementary molar ratio.

10. The electrolysis cell of claim 9, wherein an electrical potential difference is applied between the anode and the cathode of the cell and chorine is evolved on the surface of the anode of the anodic compartment to produce produce chlorine and alkali.

* * * * *